United States Patent [19]

Tratta et al.

[11] 4,231,236

[45] Nov. 4, 1980

[54] DYEING MACHINE, PARTICULARLY FOR DYEING AND DRYING STOCKING ARTICLES AND LIKE GARMENTS

[75] Inventors: Bruno G. Tratta; Ermanno Tagliaferri, both of Calvisano, Italy

[73] Assignee: Tidue S.r.l., Giovanni In Croce, Italy

[21] Appl. No.: 894,311

[22] Filed: Apr. 7, 1978

[30] Foreign Application Priority Data

Apr. 18, 1977 [IT] Italy ..... 22563A/77

[51] Int. Cl.[2] ..... D06B 5/24

[52] U.S. Cl. ..... 68/15; 68/20; 68/183; 68/184; 68/185; 68/187; 68/196

[58] Field of Search ..... 68/15, 20, 183, 184, 68/185, 187, 189, 194, 195, 196, 198, 199, 210

[56] References Cited

U.S. PATENT DOCUMENTS

| | | | |
|---|---|---|---|
| 1,948,568 | 2/1934 | Faber et al. | 68/183 X |
| 2,118,807 | 5/1938 | Carter et al. | 68/183 |
| 2,227,926 | 1/1941 | Drum et al. | 68/189 |
| 3,092,990 | 6/1963 | Schyns | 68/189 |
| 3,199,752 | 8/1965 | Casse | 68/189 X |
| 3,631,691 | 1/1972 | Karrer et al. | 68/189 X |
| 3,753,358 | 8/1973 | Masuda | 68/189 X |
| 3,927,972 | 12/1975 | Kawamura et al. | 68/187 X |

FOREIGN PATENT DOCUMENTS

| | | | |
|---|---|---|---|
| 148336 | 12/1921 | United Kingdom | 68/184 |

*Primary Examiner*—Philip R. Coe

*Attorney, Agent, or Firm*—Guido Modiano; Albert Josif

[57] ABSTRACT

A machine for dyeing and drying stocking articles and like garments comprises a vessel for containing the stocking articles to be processed, a plurality of horizontally extending perforated diaphragms within the vessel on which stocking article cakes are stacked in superimposed layers, a tubular element penetrating centrally the perforated diaphragms and extending in the vessel in an axial direction up the mouth thereof, a driven propeller within the tubular vessel, a closing cover fixed detachably to the vessel, an inlet and outlet for a processing bath, heaters for heating the bath and an inlet and outlet for drying air. The perforated diaphragms have tiltable portions for allowing loading and unloading operations.

4 Claims, 5 Drawing Figures

DYEING MACHINE, PARTICULARLY FOR DYEING AND DRYING STOCKING ARTICLES AND LIKE GARMENTS

BACKGROUND OF THE INVENTION

This invention relates to a dyeing machine, particularly for dyeing and drying stocking articles and like garments.

As is known, the processing cycle currently followed in stocking dye-houses comprises several steps, and specifically the following ones:

(1) loosening of the blocks delivered by the stocking manufacturer, termed "dozens" or "cakes", which include twelve pairs of stockings in such compressed or compacted conditions as to forbid dyeing with conventional means, and optional application of a band to each stocking dozen in order to hold them together;

(2) introduction of the stocking articles into canvas bags, of a special open mesh stitch type for dyeing purposes, either in number of two or three dozens per charge if the dyeing operation is to be carried out on a mill or turbulence type of machine, or of approximately fifty dozens if the dyeing is to be carried out in a box-type machine, and tying of the bag mouths;

(3) loading of the bags into the dyeing machines, which may be of two types, termed respectively "mill" and "box" or "cabinet";

(4) performing of the dyeing operation, in which the following adverse characteristics can be recognized:

in the mill type, which is characterized by very high values of the bath ratio (i.e. the ratio by weight of the bath made up of water and equalizing, dyeing and softening agents, to the stocking article charge) which may be as high as twenty to twentyfive, there occurs considerable wastage of water and chemicals, when it is considered that the bath is discarded on conclusion of the operation, while a significant amount of steam goes lost to the surrounding atmosphere;

in the box type, similar drawbacks are experienced, although to a smaller extent, while labor requirements are increased owing to the need for manually handling large-size bags, and moreover, there is a risk of disuniformity in dyeing due to the presence of stagnant pockets;

(5) manual unloading of the dyeing machines and transferring of the bags to the centrifugating machines;

(6) performing of such centriguation for a first partial drying of the articles, with attendant risk of excessively string wringing of the stockings and flashing or disuniform dyeing;

(7) completion of the drying step in a special oven;

(8) withdrawal of the stocking articles from the oven, opening of the bags, and reassembling of any dozens which may have come apart;

(9) transfer to warehouses, or to packaging and shipping stations.

The very list of the steps involved provided hereinabove shows what the labor and time requirements of the process can be. Additionally to the cited drawbacks and high consumption of heat connected to the operation of the machines and oven, the high investment cost inherent to the installation of all the machines required should be pointed out.

SUMMARY OF THE INVENTION

It is an object of this invention to make provision for the dyeing and drying of stocking articles by means of a single machine of very simple construction, through direct processing of the cakes delivered by the stocking article manufacturer, and a highly favorable bath ratio of about two.

Furthermore, consequently to the above, an object of the invention is to achieve a significant reduction in the labor (incidentally, only called upon to handle bags of dry material, and accordingly much lighter) and investment requirements, by reducing the work times and eliminating the heat and chemicals wastages which affect the prior art methods.

These objects are achieved by a machine, according to the invention, for dyeing and drying stocking articles and like garments, characterized in that it comprises a vessel adapted to contain the stocking articles to be processed; a plurality of perforated diaphragms arranged horizontally inside said vessel containing the stocking cakes, such as to divide vertically the space included in said vessel and allow the cakes to be stacked in superimposed layers, said perforated diaphragms being provided with driving means adapted to allow the stocking cakes to be loaded into and unloaded from the machine; a tubular element penetrating said perforated diaphragms centrally and extending in said vessel in an axial direction up to the mouth thereof; a driven propeller accomodated in said tubular element; a closing cover detachably affixed to said vessel; inlet and discharge means for the bath; means for heating the bath; and inlet and discharge means for the drying air.

BRIEF DESCRIPTION OF THE DRAWINGS

These and other functional and constructional features of the invention will be better understood from the following detailed description thereof, discussing two preferred embodiments of the invention by way of example and not of limitation.

In the accompanying drawings.

DESCRIPTION OF THE PREFERRED EMBODIMENTS

Figures 1, 2:
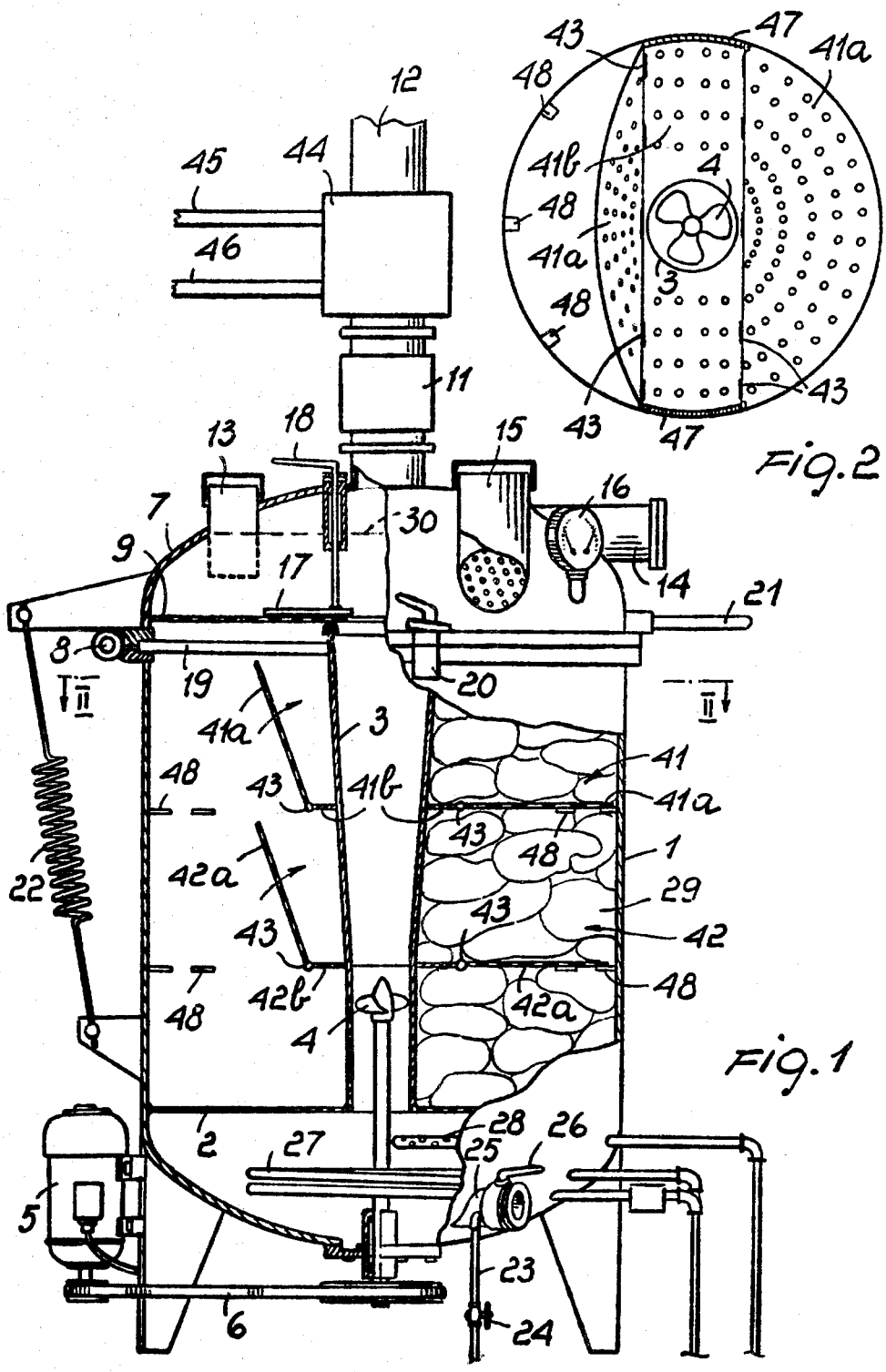
FIG. 1 is a partly sectional view of the invention.
FIG. 2 is a sectional view of the machine taken along the line II—II of FIG. 1.

With reference to FIGS. 1 and 2, there is indicated at 1 a vertically extending cylindrical vessel provided with a lower perforated diaphragm 2 located adjacent the bottom portion. The vessel 1 has a central axial channel defined by a tubular element 3 which contains a propeller 4 driven by a motor 5 through a belt 6. The motor 5 is advantageously provided with a reverse gear for reversing the direction of rotation of the propeller 4. Reversal will be carried out, of preference with a programmable rate or frequency.

The reference numeral 7 denotes a cover hinged at 8 to the vessel and equipped with an upper perforated diaphragm 9, which has a central opening 10 at the outlet end of the tubular element 3. On said cover 7, there is provided a fitting 11 for an air inlet duct 12, a bowl 13 for containing a sample of the stocking articles to be treated, a level indicator 14, a seat 15 for the insertion of additives in the bath, a dial 16 of a pressure and temperature gauge, and a gate 17, controlled through a handle 18, which is adapted to close said central opening 10 adjacent the second perforated diaphragm 9.

The cover 7 is connected in sealing engagement to the vessel 1 by means of an edge gasket or seal 19, the closing action being ensured by means known per se, schematically indicated at 20. The numeral 21 denotes a grip or handle for the opening and closing operations, which are assisted by a balancing spring 22 of the cover 7.

There is indicated at 23 a water inlet duct including a gate 24. In the proximity of the latter, there is provided a fitting 25 for connection to a water and air discharge line, which is equipped with a gate controlled through a handle 26. The inlet duct 23 terminates at the fitting 25 upstream of the gate controlled by the handle 26.

For indirectly heating the bath, there is provided a steam-conveying coil 27, while at 28 is indicated a perforated pipe which conveys steam intended to heat the bath directly by admixture.

The numeral 29, finally, denotes one of the bags containing the cakes or dozens of stocking articles, and 30 denotes the level of the water with the vessel filled.

In cooperation, the duct 23 and related gate 24, the fitting 25 with its gate controlled by the handle 26, define said bath inlet and discharge means. The means for heating the bath are defined by the coil 27 and perforated tube 28. The discharge fitting 25 also defines, together with the duct 12, said drying air inlet and discharge means.

Advantageously, the latter further comprise a heating set 44 and related steam feeding pipes 45 and steam discharging pipes 46, steam being used as the heating medium of the set; the suitably heated air performs in a most rapid manner its function of stocking drying.

A further advantageous aspect of this invention resides in that between the first and second perforated diaphragms 2 and 9, there are provided intermediate perforated diaphragms 41 and 42 of perforated metal sheet. These intermediate perforated diaphragms are composed of tiltable portions 41*a* and 42*a*, and of cross members 41*b* and 42*b*, respectively, which engage with said portions through hinges 43. The cross members 41*b* and 42*b* are rigidly connected to the walls of the vessel by means of welds 47. At 48, there are indicated supporting brackets for the tiltable portions 41*a* and 42*a*. As visible in FIG. 2, the tiltable portions 41*a* and 42*a* have each an arcuate peripheral border having a radius substantially corresponding to the radius of the vessel 1.

The inventive machine operates as follows. Cake containing bags, as delivered by the stocking article manufacturer, are introduced into the portion of the vessel 1 which is included between the two perforated diaphragms 2 and 9, the outer skirt and tubular element 3. To this end, the cover 7 is opened by acting on the handle 21 and with the assistance of the balancing spring 22, such as to lift the second perforated diaphragm 9. Then the tiltable portions 41*a* and 42*a* of the intermediate perforated diaphragms 41 and 42 are lifted, and the cakes are loaded in stacked arrangement onto the lower diaphragm 2 and intermediate diaphragms 41 and 42. After dividing the load in superimposed layers not compressed together, the cover 7 is closed and water is introduced through the duct 23 until the level 30 is reached as checked through the indicator 14. Suitable additives are then added to the bath through the seat 15, and steam is fed first through the perforated pipe 28, for a first quick heating of the bath, and subsequently through the coil 27 to carry the heating step further. Lastly, the propeller 4 is activated. The operation of said propeller exhibits the peculiarity of reversing at predetermined intervals the direction of rotation, such as to cause, at one stage, an upward movement of the water in the pipe 3, and consequently a downward flow thereof through the perforated diaphragms and bags, and viceversa at the following stage, thereby a uniform dyeing action is obtained without any risk of flashing. The dyeing operation is controlled through the sample in the bowl 13, and is very quick and effective owing to the charge being divided in spaced apart superimposed layers which facilitates the bath flow.

On completion of the dyeing step described above, during which the gate 17 is in the position shown in FIG. 1, the vessel is emptied by allowing the bath to flow out through the outlet fitting 25 and the discharge pipe. Then the gate 17 is operated until it reaches a position whereat it completely covers the central opening 10, and air begins to be admitted through the duct 12. Said air flows through the bags, picks up moisture from the stocking articles and is discharged through the fitting 25. Here too, the passage of the air is facilitated by the charge being divided into superimposed layers. Advantageously, to enhance the drying effect, the admitted air is preheated by the heating set 44.

Upon completion of the operation, the cover is opened, the bags withdrawn, and the cakes of stocking articles, dyed and ready for storage, extracted therefrom.

Figure 3:
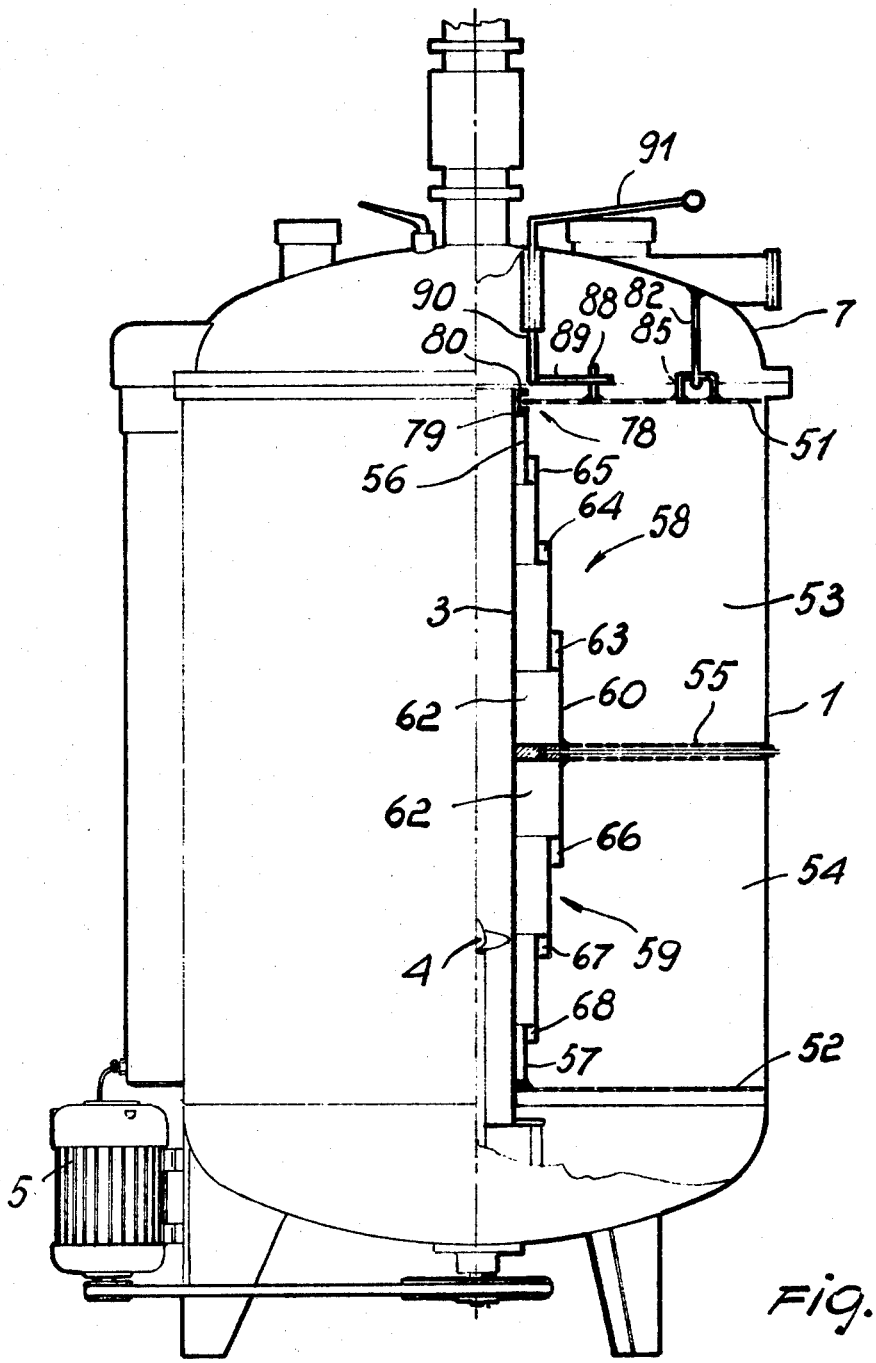
FIG. 3 illustrates a variation of the invention.
Figure 5:
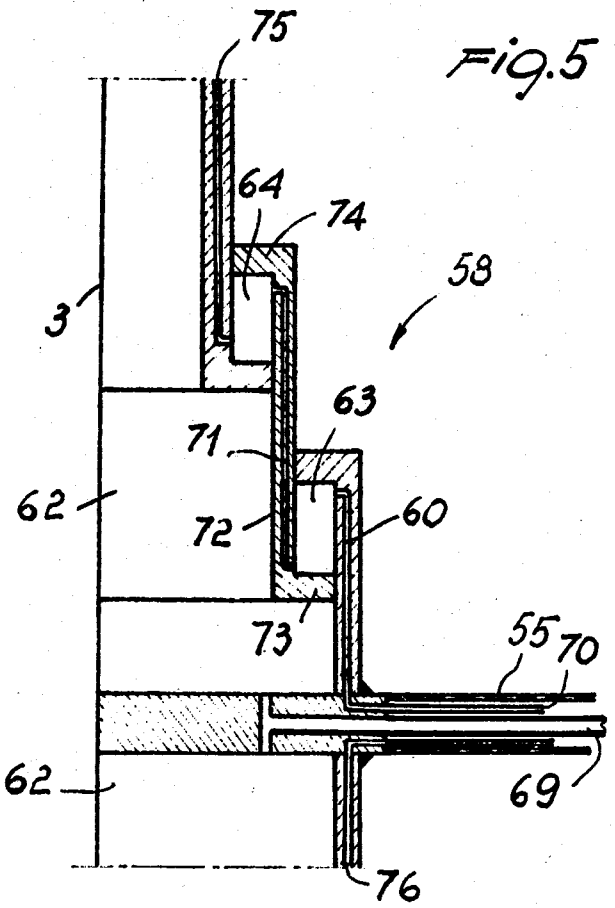
FIGS. 4 and 5 show technical details of the machine of FIG. 3.
Figure 4:
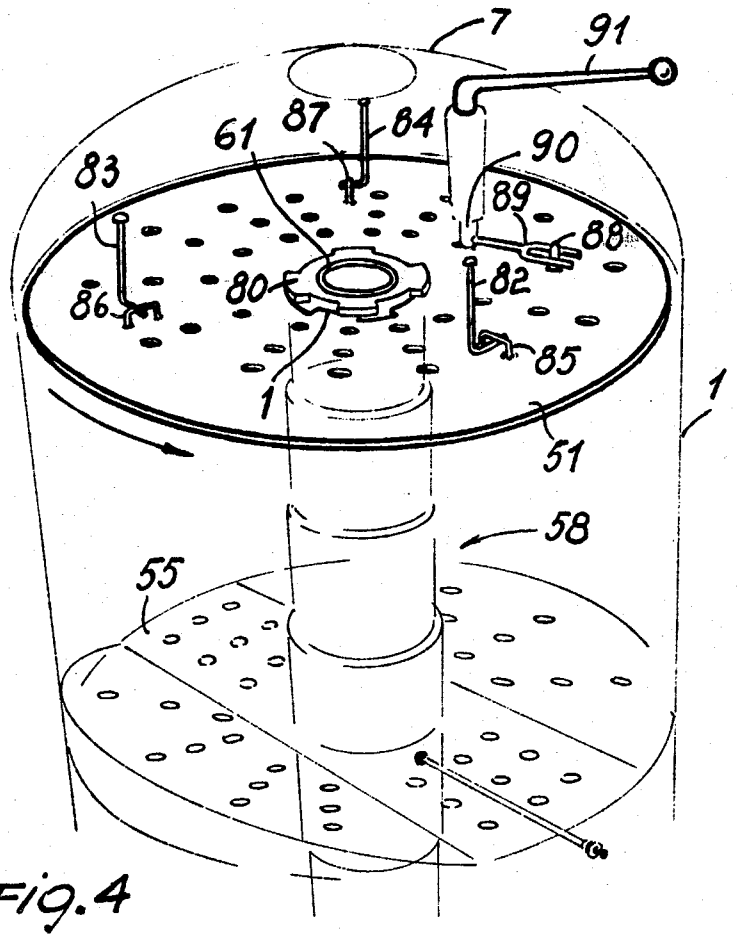

FIGS. 3 to 5 illustrate a possible advantageous variation of the machine according to the invention. In this variation, provision is made for the intermediate perforated diaphragms to be reduced to a single middle perforated diaphragm 55, shown sectioned in FIG. 3 at its fixed central crossmember. Furthermore, the first and second perforated diaphragms, indicated at 51 and 52, are now movable and effective to wring the stocking articles contained in the intermediate areas 53 and 54 of the vessel 1. The movable perforated diaphragms 51 and 52 are connected, the former through selector means which will be described in detail hereinbelow and the latter fixedly or permanently, to control the driving means comprising pistons 56 and 57 at the ends of two pluralities of pistons, generally indicated at 58 and 59, depending from the cylinder 60, which are coaxial with the tubular element 3 containing a propeller 4. Said pluralities of pistons define a space portion 62 included between the tubular element 3 and a series of chambers; in fact, the piston plurality 58 define, between the pistons themselves, chambers 63, 64 and 65, and similarly the plurality of pistons 59 define chambers 66, 67 and 68.

FIG. 5 shows the sectioned detail of part of the piston plurality 58: there is indicated at 69 a duct supplying the working fluid to the space portion 62 to cause the pistons to be lifted, while at 70 is indicated a duct, partly contained in the diaphragm 55 and partly formed in the skirt of the cylinder 60, which carries the working fluid to the chamber 63; from said chamber 63, the fluid reaches the chamber 64 through a duct 71 formed in the skirt 72 of the first piston and opening at one end at an annulus 73 formed on the outside of said skirt, and at the other end at an annulus 74 formed on the inside of the skirt.

From the chamber 64, the fluid reaches the chamber 65 through a duct 75, whereas the chambers defined by the piston plurality 59 will be filled, simultaneously with the previously described chambers and in a similar manner, with the fluid supplied through a duct 76.

The operation of this variation of the invention is clear: when it is desired to wring the stocking articles, a unit will supply the working fluid first to the pair of ducts 70 and 76 to cause the movable perforated diaphragms 51 and 52 to move closer to the fixed central middle diaphragm 55, and then to the duct 69 to produce the opposite movement, the operation being repeatable as many times as desired.

Selector means will be next described which are adapted to connect the first movable perforated diaphragm 51, or upper one, to the piston 56 or cover 7 of the vessel. At 78, there is generally indicated a collar affixed to the piston 56 and provided with two annular detents, a continuous lower one 79 and a serrated upper one 80, while at 81 is indicated a serration formed at the edge of the central hole of the diaphragm 51, matching the serration on the annular detent 80. The numerals 82, 83 and 84 denote three rods extending from the cover 7 and formed with an end portion intended to assume a horizontal lay when the cover is closed and match bridges 85, 86 and 87 connected to the first movable perforated diaphragm 51. Finally, there is indicated at 88 a pin connected to the diaphragm 51, which contacts a yoke 89 extending from a pin 90 projecting out of the cover 7 with a portion provided with an operation member 91.

It will be seen how by continuing the rotation in the direction of the arrow with respect to the position shown in FIG. 4, by actuation of the element 91 which causes the yoke 89 to rotate with attendant entrainment of the pin 88 and diaphragm 51, the serrations 81 will engage those on the annular detent 80, while the horizontal portions of the rods 82, 83 and 84 will disengage from the bridges 85, 86 and 87, thereby the diaphragm 51 remains connected to the piston 56 for the wringing step. On completion of the latter step, and as it is desired to raise the cover or lid in order to withdraw the stocking articles, it is apparent that the diaphragm 51 should be connected to said cover or lid, which is obtained by rotating the diaphragm in the opposite direction to the arrow, until the serrations 81 disengage from the serrations on the annular detent 80 and the rods engage with the bridges.

The invention as described is susceptible to many modifications and variations, all of which fall within the scope of the instant inventive concept. For example, all of the operations described hereinabove may be automated. The control or drive means effective to reciprocate the movable diaphragms could comprise a sleeve coaxially arranged with respect to the vessel and connected to the movable diaphragms by means of a right-handed threaded coupling to one diaphragm and of a left-handed one to the other diaphragm, the sleeve being reciprocated rotatively by a suitable mechanism, e.g. a worm and gear arrangement. Moreover, all the details may be replaced by technically equivalent elements.

We claim:

1. A machine for dyeing and drying stocking articles and like garments contained in bags, comprising a substantially cylindrical vessel for receiving said bags, said vessel having a cover and a bottom, a plurality of perforated diaphragms arranged horizontally inside said vessel spaced from one another for supporting said bags in superimposed layers, a tubular element penetrating said perforated diaphragms centrally and extending in said vessel coaxially thereto and spaced from said cover and said bottom, a driven propeller accommodated in said tubular element, means for supplying a treating liquid to said vessel and for discharging said liquid from said vessel, means for heating said liquid, and means for supplying drying air to said vessel and for discharging said drying air from said vessel, wherein said perforated diaphragms comprise an upper and a lower perforated diaphragm located respectively next to said cover and said bottom of said vessel, and intermediate perforated diaphragms each having a central cross member and two perforated tiltable portions, said tiltable portions being oppositely located with respect to said cross member and pivotally supported thereby to be tilted in a position allowing loading and unloading of said bags.

2. A machine according to claim 1, further comprising brackets affixed to said vessel parallel to said intermediate perforated diaphragms for supporting said tiltable portions in a substantially horizontal position.

3. A machine according to claim 1, further comprising a central opening in said upper perforated diaphragm and a gate for closing said opening during supply of said drying air.

4. A machine according to claim 1, wherein said tiltable portions have each an arcuate peripheral border having a radius substantially corresponding to the radius of said vessel.

* * * * *